US006216533B1

(12) United States Patent
Woloson et al.

(10) Patent No.: US 6,216,533 B1
(45) Date of Patent: Apr. 17, 2001

(54) APPARATUS FOR MEASURING DOWNHOLE DRILLING EFFICIENCY PARAMETERS

(75) Inventors: Scott E. Woloson; Dale A. Jones, both of Houston, TX (US)

(73) Assignee: Dresser Industries, Inc., Dallas, TX (US)

( * ) Notice: Subject to any disclaimer, the term of this patent is extended or adjusted under 35 U.S.C. 154(b) by 0 days.

(21) Appl. No.: 09/459,417

(22) Filed: Dec. 12, 1999

Related U.S. Application Data

(60) Provisional application No. 60/111,982, filed on Dec. 12, 1998.

(51) Int. Cl.[7] ..... E21B 47/00; E21B 7/08; G01V 1/40

(52) U.S. Cl. ..... 73/152.47; 73/152.01; 73/152.52; 175/45; 166/250.01; 166/250.16

(58) Field of Search ..... 73/152.01, 152.16, 73/152.46, 152.47, 152.52; 175/40, 45, 48, 50; 166/250.01, 250.07, 250.16, 254.2

(56) References Cited

U.S. PATENT DOCUMENTS

| | | | | |
|---|---|---|---|---|
| 3,817,345 | * | 6/1974 | Bailey | 180/5 NP |
| 3,884,071 | * | 5/1975 | Howeth et al. | 73/151 |
| 4,662,458 | * | 5/1987 | Ho | 175/27 |
| 4,821,563 | * | 4/1989 | Maron | 73/151 |
| 4,903,245 | * | 2/1990 | Close et al. | 367/81 |
| 4,936,147 | * | 6/1990 | EerNisse et al. | 73/702 |
| 4,958,517 | * | 9/1990 | Maron | 73/151 |
| 5,141,061 | * | 8/1992 | Henneuse | 176/56 |
| 5,386,724 | * | 2/1995 | Das et al. | 73/151 |
| 5,467,083 | * | 11/1995 | McDonald et al. | 340/854.6 |
| 5,667,023 | * | 9/1997 | Harrell et al. | 175/45 |
| 5,679,894 | * | 10/1997 | Kruger et al. | 73/152.03 |
| 5,812,068 | * | 9/1998 | Wisler et al. | 340/855.5 |

* cited by examiner

*Primary Examiner*—Hezron Williams
*Assistant Examiner*—David J. Wiggins
(74) *Attorney, Agent, or Firm*—Cox & Smith Incorporated

(57) ABSTRACT

A downhole drilling efficiency sensor (DES) apparatus for use with drilling operations in oil and gas exploration, that accurately measures important drilling parameters at or near the drill bit in order to increase the effectiveness and productivity of the drilling operation. The parameters measured include weight-on-bit (WOB), torque-on-bit (TOB), bending-on-bit (BOB), annulus pressure, internal bore pressure, triaxial vibration (DDS—drilling dynamics sensor), annulus temperature, load cell temperature, and drill collar inside diameter temperature or thermal gradient across such drill collar. The direction of the bending-on-bit measurement is also determined with respect to the low side of the hole while rotating (or stationary) by using a triaxial vibration sensor and magnetometer array. Each of the parameters are known to be important factors in determining the direction, rotation, and rate of drilling. The device described combines sensors capable of collecting all of the indicated parameters and presenting them to the drilling operator such that an accurate view of the downhole drilling parameters can be obtained.

11 Claims, 2 Drawing Sheets

APPARATUS FOR MEASURING DOWNHOLE DRILLING EFFICIENCY PARAMETERS

CROSS REFERENCE TO RELATED APPLICATIONS

This application claims the benefit of U.S. Provisional Patent Application Ser. No. 60/111,982, filed Dec. 12, 1998.

BACKGROUND OF THE INVENTION

1. Field of the Invention

The present invention relates generally to devices and tools for the measurement of downhole environmental parameters during oil and gas drilling operations. The present invention relates more specifically to a downhole drilling efficiency sensor for use with oil and gas drilling operations that accurately measures drilling parameters at or near the drill bit in order to increase the effectiveness and productivity of the drilling operation.

2. Description of the Related Art

U.S. Pat. No. 4,662,458 issued to Ho entitled Method and Apparatus for Bottom Hole Measurement and commonly assigned with the present application describes a downhole tool with strain gauges and includes measurements for weight-on-bit (WOB), torque-on-bit (TOB), bending-on-bit (BOB), and side forces.

U.S. Pat. Nos. 4,821,563 and 4,958,517, both issued to Maron and both entitled Apparatus for Measuring Weight, Torque, and Side Force on a Drill Bit, each describe an apparatus that includes strain gages located in radial holes in the wall of the drill collar sub. The strain gages are position in a non-symmetrical arrangement.

U.S. Pat. No. 5,386,724 issued to Das et al. entitled Load Cells for Sensing Weight and Torque on a Drill Bit While Drilling a Well Bore also describes the use of an array of load cells made up of strain gages for measuring weight and torque parameters. The Das et al. disclosure includes a recent review of the relevant art and a description of selected methods for calculating strain using strain gages of the type employed herein and is therefore cited and incorporated by reference herein in its entirety.

SUMMARY OF THE PRESENT INVENTION

The present invention provides a downhole drilling efficiency sensor (DES) apparatus for use with drilling operations in oil and gas exploration, that accurately measures important drilling parameters at or near the drill bit in order to increase the effectiveness and productivity of the drilling operation. The parameters measured include weight-on-bit (WOB), torque-on-bit (TOB), bending-on-bit (BOB), annulus pressure, internal bore pressure, triaxial vibration (DDS—Drilling Dynamics Sensor) annulus temperature, load cell temperature, and drill collar inside diameter temperature. The direction of the bending-on-bit measurement is also determined with respect to the low side of the hole while rotating (or stationary) by using a triaxial vibration sensor and magnetometer array.

DESCRIPTION OF THE PREFERRED EMBODIMENT

Figure 1:
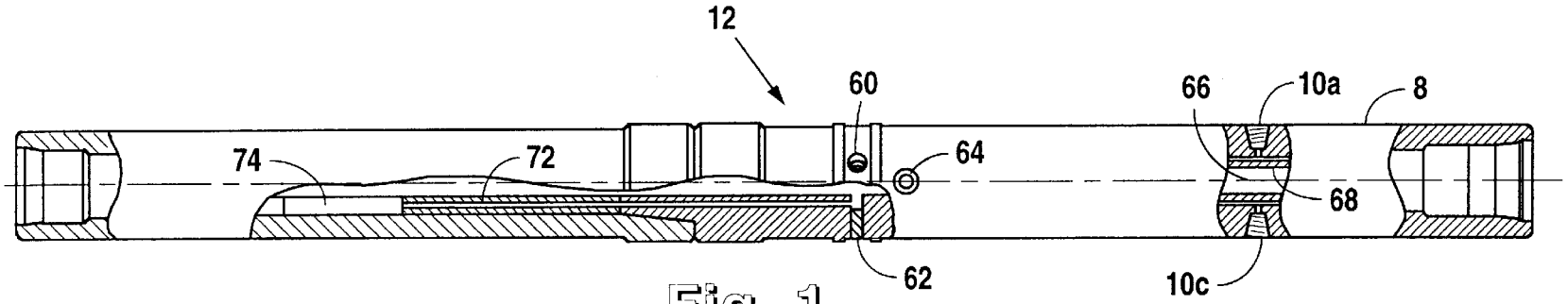
FIG. 1 is a partial cross-sectional view of the structural configuration of the apparatus of the present invention.
Figure 2B:
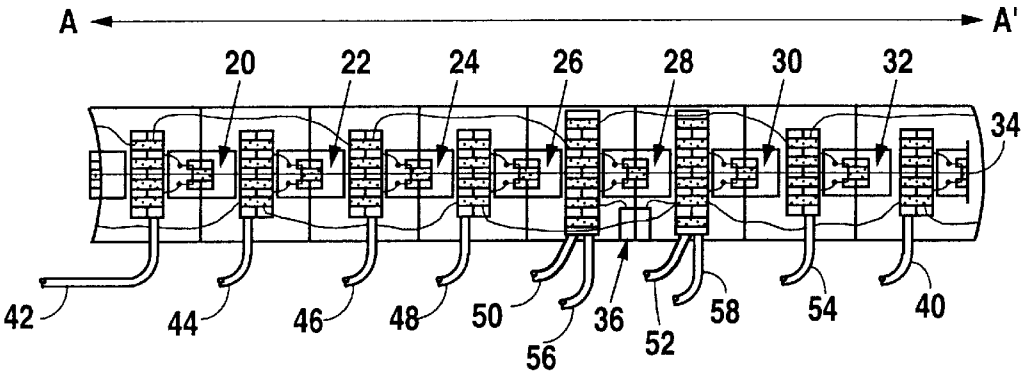
FIG. 2*b* is a schematic side view of a representative load cell of the present invention showing the position of the associated strain gauges shown in FIG. 2*a*.
Figure 2A:
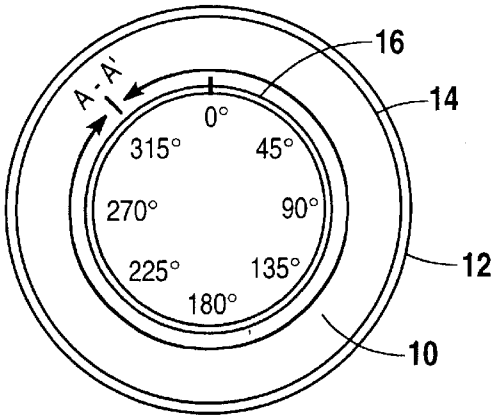
FIG. 2*a* is a circumfrentially expanded view of the strain gauges of the present invention positioned on an inside diameter of the load cell of the present invention.
Figure 3B:
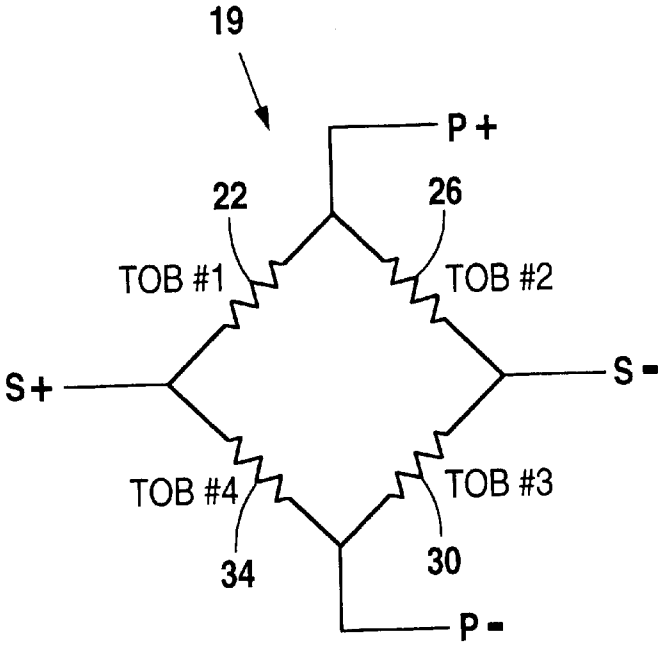
FIG. 3*b* is an electronic schematic diagram showing a representative torque-on-bit Wheatstone bridge circuit.
Figure 3A:
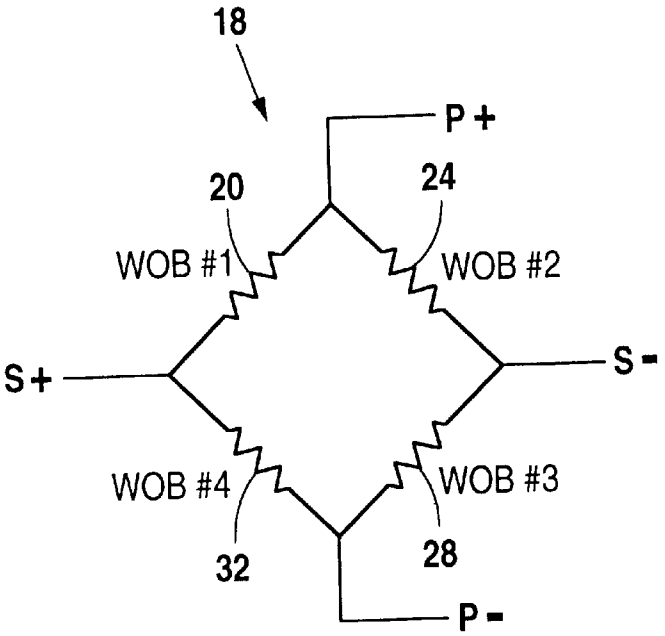
FIG. 3*a* is an electronic schematic diagram showing a representative weight-on-bit Wheatstone bridge circuit.

Reference is made first to FIG. 1 for a detailed description of the overall structure of the present invention. Four independent load cells (10*a*)–(10*d*) are mounted at either a single cross-sectional position or may be spaced apart at 90° intervals around drill collar wall (8). Each load cell (10*a*)–(10*d*) comprises a ring (14) (best seen in FIG. 2*a*) consisting of two independent Wheatstone bridges (18) and (19) (best seen in FIGS. 3*a* and 3*b*) with each bridge being constructed of four foil strain gauges (20), (24), (28), (32) and (22), (26), (30), (34) (best seen in FIG. 2*b*). The gauges (20)–(34) are located on the inside diameter wall (16) of the ring (14). The load cells (10*a*)–(10*d*) are press fit into the drill collar (8) and sealed in an atmospheric chamber. The gauges (20)–(34) are covered with a protective coating and the atmospheric chamber is dry inert gas purged before the assembly is sealed. The necessary electrical connections (40)–(58) are provided to each of the strain gauges (20)–(34) and the temperature sensors (36) (described in more detail below). Routing of these conductors (40)–(58) within the tool is accomplished in a manner well known in the art. Appropriate electronics, also well known in the art and not disclosed herein, are utilized to make the appropriate resistance measurements and the associated strain calculations.

The drill collar wall (8) in which the load cells (10*a*)–(10*d*) are located is thermally insulated (68) from the borehole fluid (66). Applied forces to the drill collar (8) cause the load cell rings (10*a*)–(10*d*) to deform from a circular geometry into an oval geometry (see for example FIGS. 10 and 11 in the Das et al. patent). The distortion of the load cells (10*a*)–(10*d*) causes either the weight-on-bit (WOB) or the torque-on-bit (TOB) resistances to change. This resistance change is calibrated in advance for a given load. Since each load cell (10*a*)–(10*d*) provides an independent measurement, the bending-on-bit (BOB) can be calculated with the drill string (12) either stationary or rotating. The independent load cells (10*a*)–(10*d*) also allow for redundant measurements of weight-on-bit, torque-on-bit, and bending-on-bit.

The direction of the bending-on-bit with respect to the low side of the hole can be determined using a triaxial vibration sensor and magnetometer array (72) for finding and tracking the low side of the hole even while rotating.

Three RTD temperature sensors (36*a*)–(36*c*) are radially spaced in the drill collar wall (8) in line with the load cells (10*a*)–(10*d*). The RTD sensors (36*a*)–(36*c*) measure the drill collar outside diameter temperature, the load cell temperature, and the drill collar inside diameter temperature. From the temperature sensor (36*a*)–(36*c*) locations the temperature gradient across the drill collar wall (8) can be determined.

The apparatus of the present invention additionally comprises two fluid communication ports (60) and (62) which communicate fluid pressure through the drill collar wall (8) to insert mounted pressure transducers. One port (60) is ported to the annulus and the other port (62) is ported to the internal bore to allow for measuring the respective pressures. In addition, a side wall readout (64) is provided as shown in FIG. 1.

A triaxial vibration sensor (DDS) (72), as is known in the art, measures the g-levels (acceleration forces) that the tool is subjected to while in operation.

The apparatus of the present invention provides a drilling efficiency sensor (DES) with the ability to measure a number of drilling parameters. Prior efforts have only made questionable attempts to correct for the effects of temperature and pressure variations on the load cells used and generally do not provide means for measuring all of these important environmental parameters. The apparatus of the present invention measures these ancillary parameters and determines their effect on the load cell in a manner that permits accurate correction of the load cell output. The appropriate algorithms for incorporating the effects of these parameters into the corrected calculations of the various force measurements is known in the field.

By utilizing the ring structure of the present invention, load cell sensitivity is dramatically increased. This eliminates the need to couple a half bridge from one load cell to the half bridge of the other load cell as is described in Das et al. (referenced above). In addition, since the entire Wheatstone bridge is located on one removable ring, the load cells of the present invention are more reliable, easier to assemble, and easier to maintain.

The ring structure of the present invention allows the load cell sensitivity to be adjusted by increasing or decreasing the ring's wall thickness. By having four independent Wheatstone bridge measurements, located at 90° intervals from each other, the bending moment can be determined regardless of drill string rotation. The Moran disclosures referenced above describe the calculation of bending-on-bit while rotating by coupling a half bridge from one port to the half bridge of the other port. Coupling of bridges is not required with the apparatus of the present invention. The Das et al. disclosure does not include a bending-on-bit calculation. In addition, in the Das et al. disclosure, weight-on-bit measurements have an uncorrectable error from bending-on-bit due to the coupling of the half bridges. The sum of this coupling ends up being included in the measurement.

As indicated above, the Drilling Efficiency Sensor apparatus of the present invention incorporates three RTD temperature sensors, radially spaced in the drill collar wall, in line with each of the four load cells. The temperature sensors are radially located in order to measure temperature at the drill collar's outside diameter, the drill collar's inside diameter, and at the load cells. A temperature gradient can therefore be measured across the drill collar wall. This allows for a correction of each load cell's output to remove the effects of thermal stresses that are generally present in the drill collar wall. The temperature sensors also allow for a steady state temperature correction to be made (not just fluctuations in temperature or temperature gradients). The systems described in the prior art generally have no mechanisms for correcting for temperature gradients or for determining steady state temperature offset. Instead, many systems in the prior art incorrectly suggest that locating the strain gauge(s) at a mid wall position in the drill collar will nullify the effects of thermal stresses.

The drill collar wall in which the load cells of the present invention are positioned is thermally isolated from the bore fluid and its temperature. This structural geometry makes a temperature gradient correction possible since there is essentially only a single thermal effect on the load cells. This structure also allows the drill collar wall in which the load cells are located to reach a constant temperature, giving a more stable measurement that for the most part remains unaffected by the temperature differential between the internal bore fluid and the annulus fluid. Given that the internal bore fluid and annulus fluid temperatures are different (as is most often the case), the prior art systems will generally be subject to a temperature gradient across the drill collar wall in which the load cells are located. The prior art has generally not been able to correct for the effect that this temperature gradient has on load cell output.

In addition, the apparatus of the present invention has two insert mounted quartz pressure transducers (74) (seen best in FIG. 1) that are ported (60) and (62) to the annulus and internal bore through the drill collar wall (8). Since the transducers (74) are insert mounted, they are easy to install and maintain. These transducers measure the annulus and internal bore fluid pressures and correct the load cell's output for the effects of any pressure differential across the drill collar wall. The effect of a pressure differential across the drill bit (axial and tangential stress) can also be corrected for. The systems described in the prior art have applied questionable methods to correct for pressure differentials across the drill collar wall and cannot correct for the pressure differential across the bit. In general, the prior art systems do not provide mechanisms for measuring downhole pressures.

Finally, the apparatus of the present invention provides a triaxial vibration sensor (DDS—Drilling Dynamics Sensor) that is capable of measuring the g-levels (acceleration forces) that the drill string is subjected to. The systems described in the prior art do not generally provide mechanisms for measuring these forces.

The direction of the bending-on-bit with respect to the low side of the bore hole can be determined by the present invention by using the triaxial vibration sensor and magnetometer array (72) to find and track the low side of the hole even while the drill string is rotating. The systems described in the prior art do not generally provide mechanisms for determining the direction of the bending-on-bit with respect to the low side of the bore hole.

What is claimed is:

1. A downhole drilling parameter sensor device for use with drilling operations of a borehole used in oil and gas exploration, the sensor device comprising:

a plurality of independent load cells orthogonally positioned within a drill collar wall of a drill string, where said drill collar has an inside diameter and an outside diameter, with said load cells comprising:

a first Wheatstone bridge comprising four strain gauges orthogonally positioned within a ring configuration within said load cell; and a second Wheatstone bridge comprising a set of four strain gauges orthogonally positioned within a ring configuration within said load cell;

a plurality of temperature sensors positioned within said drill collar wall and arrayed to measure temperatures at locations comprising said drill collar's outside diameter, said drill collar's inside diameter, and said load cells;

a triaxial vibration sensor positioned within said drill string proximate to said load cells;

a magnetometer array positioned within said drill string in physical association with said triaxial vibration sensor;

a first pressure transducer positioned within said drill string in fluid communication with an annular volume surrounding said drill string within said borehole; and a second pressure transducer positioned within said drill string in fluid communication with an internal bore of said drill string;

wherein said plurality of independent load cells provide for redundant measurements of weight-on-bit, torque-on-bit, and bending-on-bit forces parameters, said plurality of temperature sensors provide for measurements of temperature gradients across the load cells so as to correct said load cell measurements for any temperature dependent errors, said triaxial vibration sensor and said magnetometer array provide for measurements of drill string motion to provide for finding and tracking drill string rotational orientation within the borehole, and said pressure transducers provide for measurement of pressure variations so as to correct said load cell measurements for any pressure dependent errors.

2. The sensor device of claim 1 wherein said strain gauges comprise foil strain gauges covered with a protective coating and located on an inside diameter of a ring member element of said load cells.

3. The sensor device of claim 1 wherein said plurality of load cells number four, are ring-shaped in configuration, and are press-fit into circular recesses positioned within said drill collar wall.

4. The sensor device of claim 1 further comprising a read-out port in a side wall of said drill collar for electrical connection between a set of input and output conductors associated with said load cells, said temperature sensors, said pressure transducers, said triaxial vibration sensor, and said magnetometer array, and an external data collection device.

5. The sensor device of claim 1 wherein an internal wall of said drill collar at said inside diameter is thermally insulated from a drilling fluid used in operation of said drill string within said borehole.

6. The sensor device of claim 1 wherein said drill collar wall is thermally insulated from a drilling fluid used in operation of said drill string within said borehole.

7. A sensor array for use with oil and gas borehole drilling operations comprising:

a plurality of strain gauge load cells positioned within a drill collar wall of a drill string, said drill collar wall having an inside and outside diameter, each of said load cells comprising at least two Wheatstone bridge circuits, each circuit comprising a set of four strain gauges orthogonally positioned within a ring configuration within said load cell;

a plurality of temperature sensors positioned within said drill collar wall and arrayed to measure temperatures at said drill collar inside and outside diameters, and said load cells;

a triaxial vibration sensor positioned proximate to said load cells;

a magnetometer array positioned proximate to said triaxial vibration sensor;

a first pressure transducer in fluid communication with an annular volume surrounding said drill string within said borehole; and a second pressure transducer in fluid communication with an internal bore of said drill string;

wherein said plurality of load cells provide weight-on-bit, torque-on-bit, and bending-on-bit force parameters, said plurality of temperature sensors provide temperature gradient values across said load cells so as to correct said load cell measurements, said triaxial vibration sensor and said magnetometer array provide measurement of drill string motion, and said pressure transducers provide measurement of pressure variations so as to correct said load cell measurements.

8. The sensor array of claim 7 wherein each of said strain gauges comprise foil strain gauges covered with a protective coating and located on an inside diameter of a ring member element of said load cells.

9. The sensor array of claim 7 wherein said plurality of load cells number four, are ring-shaped in configuration, and are press-fit into circular recesses positioned within said drill collar wall.

10. The sensor array of claim 7 further comprising a read-out port positioned in said drill collar wall for electrical connection between a set of input and output conductors associated with said load cells, said temperature sensors, said pressure transducers, said triaxial vibration sensor, and said magnetometer array, and an external data collection device.

11. The sensor array of claim 7 wherein an internal wall of said drill collar at said inside diameter is thermally insulated from a drilling fluid used in operation of said drill string within said borehole.

* * * * *